US010597976B2

(12) United States Patent
Rorvik

(10) Patent No.: US 10,597,976 B2
(45) Date of Patent: Mar. 24, 2020

(54) BALL DROP TOOL AND METHODS OF USE

(71) Applicant: Halliburton Energy Services, Inc., Houston, TX (US)

(72) Inventor: Helge Rorvik, Sandness (NO)

(73) Assignee: Halliburton Energy Services, Inc., Houston, TX (US)

( * ) Notice: Subject to any disclaimer, the term of this patent is extended or adjusted under 35 U.S.C. 154(b) by 218 days.

(21) Appl. No.: 15/566,143

(22) PCT Filed: May 26, 2015

(86) PCT No.: PCT/US2015/032381
§ 371 (c)(1),
(2) Date: Oct. 12, 2017

(87) PCT Pub. No.: WO2016/190850
PCT Pub. Date: Dec. 1, 2016

(65) Prior Publication Data

US 2018/0087348 A1 Mar. 29, 2018

(51) Int. Cl.
*E21B 34/14* (2006.01)
*E21B 17/10* (2006.01)
*E21B 34/06* (2006.01)

(52) U.S. Cl.
CPC ..... *E21B 34/14* (2013.01); *E21B 17/1078* (2013.01); *E21B 34/066* (2013.01)

(58) Field of Classification Search
CPC ..... E21B 17/1078; E21B 34/14; E21B 34/066
See application file for complete search history.

(56) References Cited

U.S. PATENT DOCUMENTS

| | | | | |
|---|---|---|---|---|
| 5,758,726 | A | 6/1998 | Streich et al. | |
| 10,006,272 | B2 * | 6/2018 | Radford | E21B 10/322 |
| 2004/0055753 | A1 | 3/2004 | Davis et al. | |
| 2010/0288496 | A1 | 11/2010 | Cherewyk | |
| 2014/0102717 | A1 | 4/2014 | Cherewyk | |
| 2015/0008041 | A1 | 1/2015 | Hall et al. | |
| 2016/0222764 | A1 | 8/2016 | Rorvik | |

OTHER PUBLICATIONS

International Search Report and Written Opinion of PCT Application No. PCT/US2015/032381 dated Jan. 28, 2016: pp. 1-15.

* cited by examiner

*Primary Examiner* — Robert E Fuller
(74) *Attorney, Agent, or Firm* — Chamberlain Hrdlicka

(57) ABSTRACT

Disclosed examples include a ball drop tool located in a drill string. The ball drop tool may be a drilling stabilizer that includes a drilling stabilizer housing having an interior passage to be coupled to a drill string. A at least one stabilizing blade is on an external surface of the housing. The stabilizing blade includes a hollow compartment to hold at least one ball. A gate valve couples the hollow compartment of the stabilizing blade to the interior passage. Gate valve circuitry is coupled to the gate valve for controlling operation of the gate valve to controllably release one or more of the balls.

20 Claims, 5 Drawing Sheets

BALL DROP TOOL AND METHODS OF USE

BACKGROUND

The exploration and recovery of hydrocarbons such as oil and gas generally begins with drilling a borehole into a potentially hydrocarbon-bearing geological formation. In many types of drilling operations, it may be desirable to remotely activate one or more downhole tools to perform a desired function. For example, an underreamer may be activated and operated to ream a previously drilled borehole to expand its diameter.

Some tools are remotely activated, by dropping a ball downhole. Such a tool may be designed so that when the dropped ball reaches the tool, the ball engages a seat to close or restrict a flow passage, to pressurize fluid above an activation set point.

DETAILED DESCRIPTION

Various embodiments of a ball drop tool are disclosed that may be placed in service downhole at a well site to activate various other downhole tools. When in use, the ball drop tool may be physically located downhole above the ball-activated tool. The ball drop tool may have hollow portions to hold one or more activation balls (alternatively referred to simply as balls) for selectively releasing, i.e. dropping, the balls. In most examples, the ball drop tool is run into a well with one or more balls already retained within the tool. In some examples, however, it may be possible to supply the balls to the tool after the drill string is in the borehole. For purposes of discussion only, the ball drop tool is embodied as a drilling stabilizer in the various examples discussed. However, a person of ordinary skill in the art will appreciate that any other downhole tools may be configured as ball drop tools according to the teachings of this disclosure, and therefore, in the claims that follow, a ball drop tool is not necessarily limited to being a drilling stabilizer.

A "ball" may be defined as any device configured to engage a seat as subsequently described. Even though a ball is subsequently shown as having a spherical configuration, for purposes of illustration only, a ball may include non-spherical configurations such as darts, plugs, semi-ellipsoidal configurations, and other configurations capable of sealing or restricting the passage of fluids by engaging a seat of an activation or de-activation mechanism in the tool string. The disclosed balls are releasable balls in that they may be held or contained and selectively released by the disclosed ball drop tool.

Figure 1:
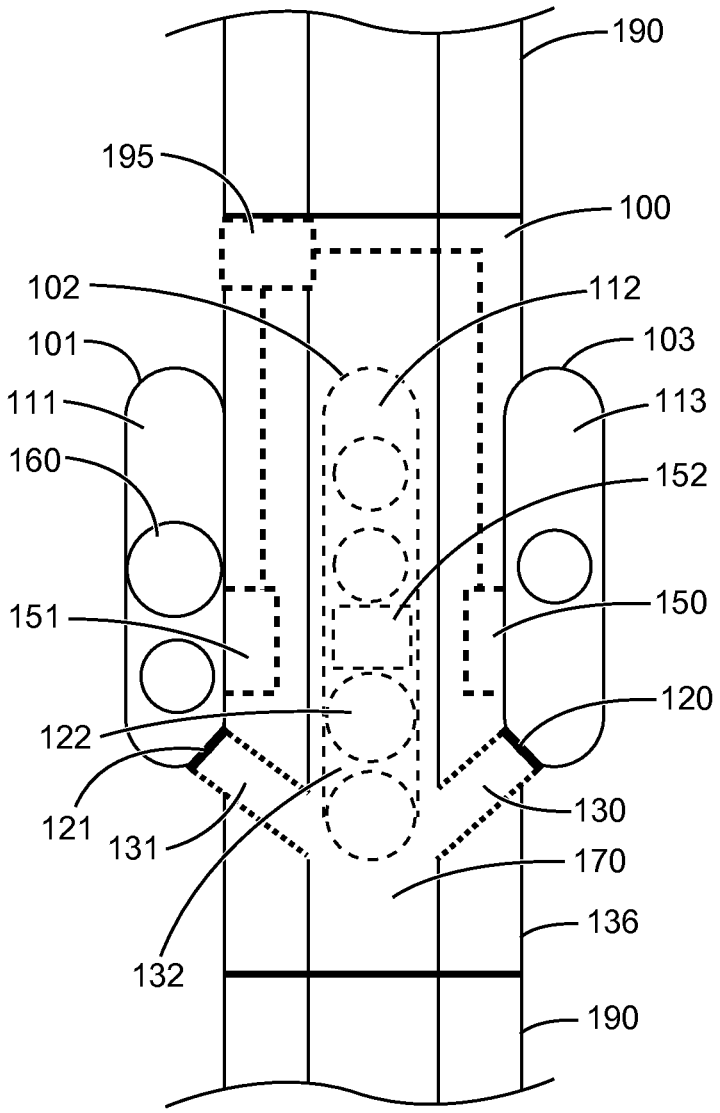
FIG. 1 is a cross-sectional diagram showing an example ball drop tool, according to various aspects of the present disclosure.

FIG. 1 is a cross-sectional diagram showing an example ball drop tool 100, according to various aspects of the present disclosure. For example, the ball drop tool 100 may be a drilling stabilizer tool 100 having hollow portions (e.g., stabilizing blades) 101-103 that are configured to hold the balls 160. The drilling stabilizer tool 100 is a downhole tool that may be used in a bottom hole assembly (BHA) of a drill string 190 or on other locations of the drill string 190. The stabilizer tool 100 mechanically also operates to stabilize the BHA in a borehole in order to reduce vibrations and unintentional sidetracking of the drill string 190 in order to improve the quality of the hole being drilled.

The stabilizer 100 includes a hollow, cylindrical, drilling stabilizer housing 136 with one or more stabilizing blades 101-103 on an external surface of the stabilizer housing 136. The hollow cylindrical housing 136 enables fluid (e.g., drilling mud) to be injected downhole from the surface and through an interior passage 170 of the stabilizer 100.

The blades 101-103 may be either straight or spiral shaped and are typically hard surfaced for wear resistance. In an example, one blade may wrap around the housing in a spiral configuration. One or more of the blades 101-103 comprise a substantially hollow compartment 111-113 in order to hold one or more balls 160 for dropping through the drill string 190. The blades 101-103 may hold the same size balls 190 in all of the blades 101-103, different size balls 190 in each of the blades 101-103, and/or different types (e.g., spherical, semi-ellipsoid, dart, plug) of balls in each of the blades 101-103.

For example, a hollow compartment 111 of one blade 101 may hold a first size or type of ball 190, a hollow compartment 112 of a second blade 102 may hold a second size or type of ball, and a hollow compartment 113 of a third blade 103 may hold a third size or type of ball where each of the first, second, and third sizes or types are different as compared to the other hollow compartments. In another example, the blades 101-103 may each have different sizes or types of balls within the hollow compartments 111-113 of that particular blade 101-103.

The balls 190 may be selectively released from their respective blade 101-103 by a respective gate valve 120-122. Each gate valve 120-122 may be individually controlled such that only one gate valve is open at any one time and, thus, only one ball 190 is released into the interior passage 170 of the stabilizer 100 at any one time. When a gate valve 120-122 is opened, a selected ball 190 is allowed to exit its respective blade 101-103 through a respective chute 130-132 that connects that hollow interior of that blade 101-103 to the interior passage 170 of the stabilizer 100.

The gate valves 120-122 may be controlled by gate valve circuitry 150-152 that controls the operation (e.g., opening, closing) of its respective gate valve 120-122. The gate valve circuitry 150-152 may be coupled to tool control circuitry 195 within the tool and responsible for receiving ball release commands and determining which gate valve circuitry 150-152 to activate, in response to the ball release commands, in order to release a desired ball through the respective gate valve 120-122. Thus, in many examples, the gate valves 120-122 are selectively activated by the tool control circuitry 195 and/or the gate valve circuitry 150-152 such that any one gate valve 120-122 is opened at any one time.

Figure 3:
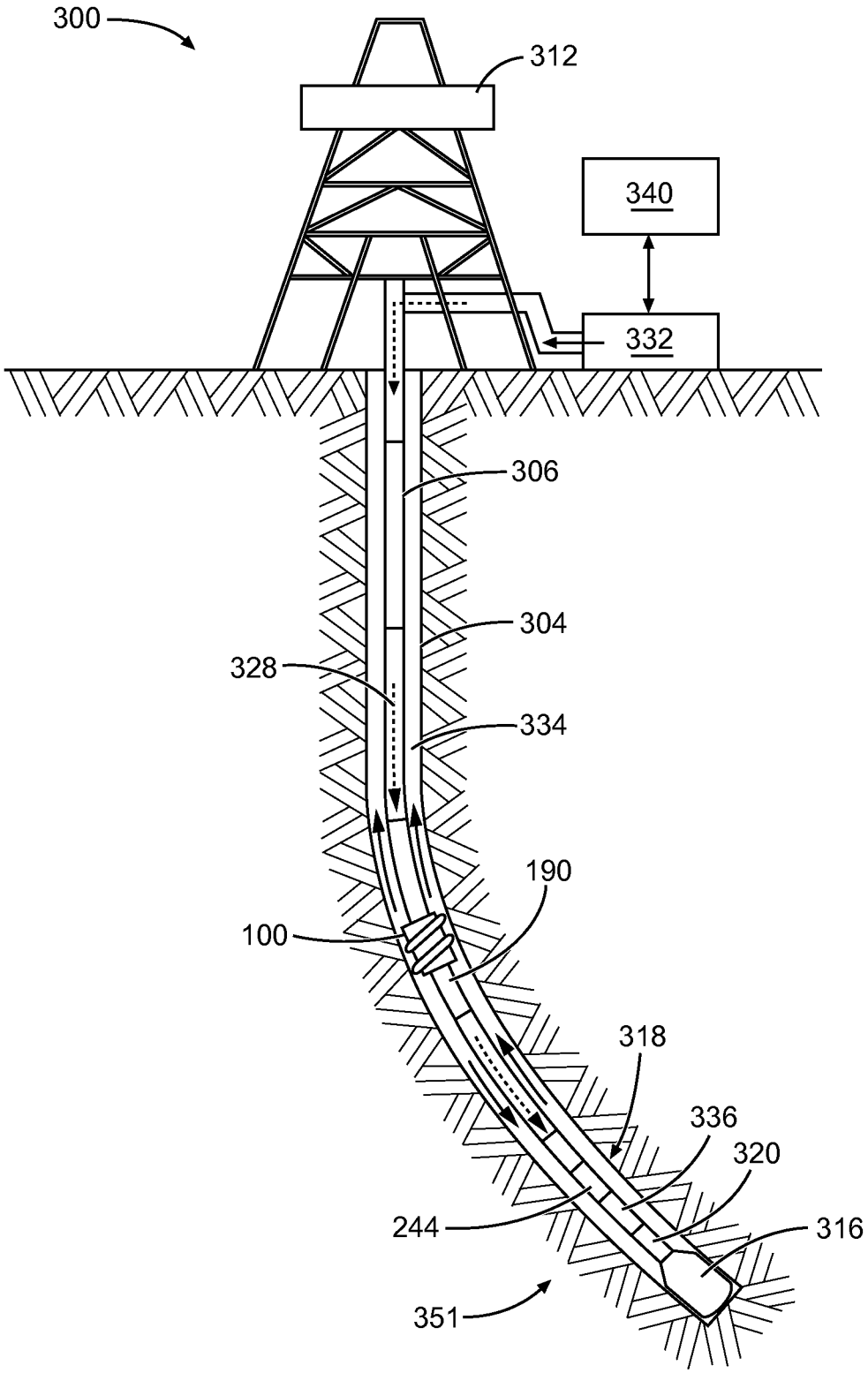
FIG. 3 is a diagram showing an example system for controlling the activation of a downhole tool with a ball drop tool, according to various aspects of the present disclosure.

As an example of operation, the tool control circuitry 195 may receive control signals from control circuitry on the surface 340 and/or from control circuitry in the BHA 351 (see FIG. 3). The control circuitry on the surface 340 and/or in the BHA 351 may determine which size and/or type of ball is desired for a particular operation and sends a command to the tool control circuitry 195. The tool control circuitry 195, having predetermined knowledge regarding which size and type of ball is located in each blade 101-103 (e.g., stored in memory (see FIG. 5)), then determines the respective gate valve circuitry 150-152 to enable in order to open that respective gate valve 120-122.

The circuitry 150-152 opens its respective gate valve 120-122 to enable the desired ball 190 to exit the respective blade 101-103 through its respective chute 130-132 and into the interior passage 170 of the tool 100 and the drill string 190. Once the selected ball has traveled downhole and been engaged by a ball seat within a fluid path of a ball activated tool, the fluid pressure increases in the ball activated tool such that the increased fluid pressure in the blocked fluid path activates a mechanism of the ball activated tool. Such a mechanism may include, for example, a sliding sleeve mechanism or a piston among others.

The balls 190 may be allowed to exit their respective chute 130-132 by gravity or with the assistance of some type of force pushing the ball into the interior passage 170 of the tool 100. For example, a force caused by a fluid (e.g., drilling mud), a spring force, or a compressed gas force may be used to eject, or to help eject, the ball from its respective chute 130-132 if the force of gravity is insufficient (e.g., when the tool 100 is in a horizontal position).

Figure 2:
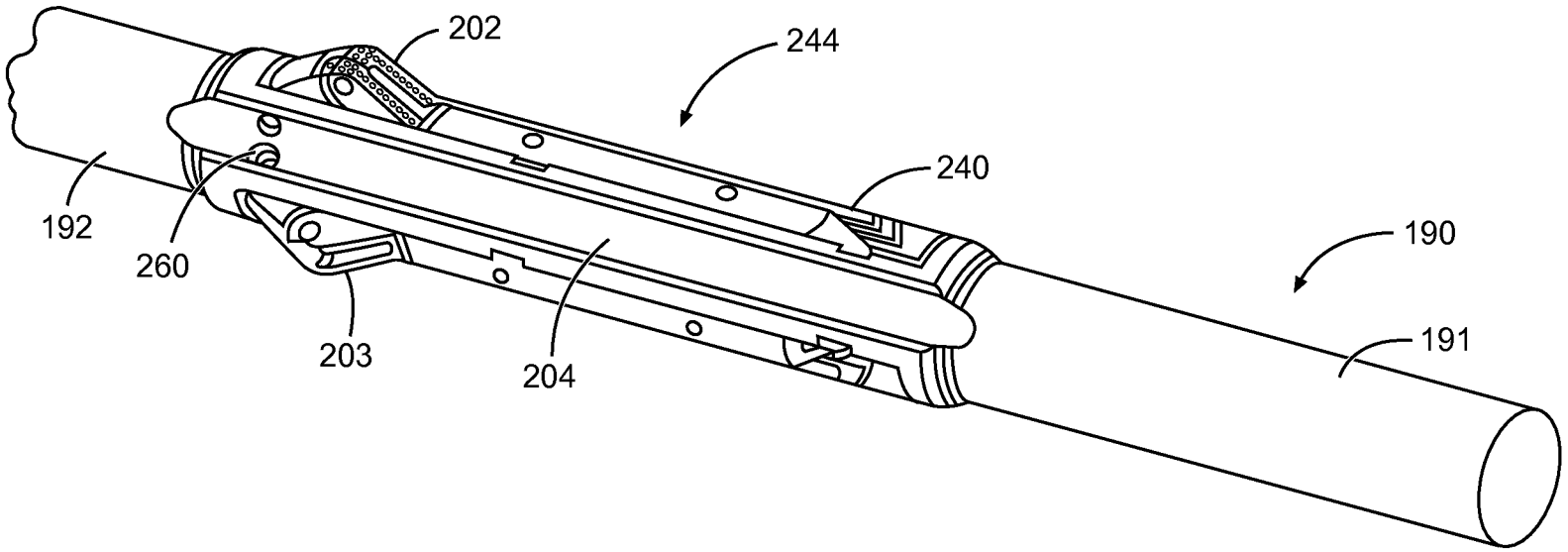
FIG. 2 is a diagram showing an example downhole tool that may be activated using an activation ball dropped from a ball drop tool, according to various aspects of the present disclosure.

FIG. 2 is a diagram showing an example downhole tool that may be activated using an activation ball dropped from a ball drop tool, according to various aspects of the present disclosure. For purposes of illustration only, the downhole tool may be an underreamer 244. Other examples may incorporate other ball activated downhole tools (e.g., flow bypass tools, coring tools during cementing operations, liner hanger operations) that utilize the activation ball to seal an opening in a fluid path.

The example underreamer 244 may form part of the drill string 190. The underreamer 244 includes a plurality of controllable arms 202, 203, each having cutting elements, that may be extended or retracted in response to fluid pressure changes. The underreamer 244 is depicted in a deployed (e.g., activated) condition. In this deployed condition, the underreamer arms 202, 203, with the supported cutting elements, are radially extended from the underreamer housing 240 to enable contact with the borehole sidewall for reaming of the borehole when the underreamer housing 240 rotates with the drill string 190. In this example, the underreamer arms 202, 203 are mounted on the underreamer housing 240 in axially aligned, hingedly connected pairs that extend into deployment when activated.

When, in contrast, the underreamer 244 is in the deactivated condition (not shown), the underreamer arms 202, 203 are retracted into the tubular underreamer housing 240. In the deactivated condition (i.e., retracted position), the underreamer arms 202, 203 do not project beyond the radial outer surface of the underreamer housing 240. Thus, the deactivated condition may clear the annulus around the drill string 190. Different activation mechanisms for the underreamer 244 may be employed in various embodiments.

The underreamer 244 includes an interior passage 204 that allows a fluid (e.g., drilling fluid) to pass through an upper portion 191 of the drillstring 190 through the interior passage 204 to a lower portion 192 of the drillstring 190. The fluid exits a lower portion of the underreamer housing 240 through one or more ports 260 that are connected to the lower portion 192 of the drill string 190. Plugging the port 260 with the activation ball from the ball drop tool 100 causes the fluid to build up in the underreamer 244 and the drill pipe 190, thus causing the underreamer arms 202, 203 to activate (e.g., extend).

In some applications, activation balls may be dropped from the surface to travel down the drillstring 190 or tubing and engage the ball seat substantially surrounding the one or more ports 260. However, in some applications, there may be downhole devices in the drill string 190 that have restrictions preventing a ball from passing through to the underreamer 244 or other tools to be activated. For example, filter screens may be run downhole to keep debris and drilling fluid particulate from plugging off small passages in tools positioned below. Activation balls are unable to pass through the filter screens. Similarly, a MWD (or LWD) tool may also provide a flow path obstruction that prohibits a dropped ball from actuating tools positioned downhole of the MWD tool. The use of the downhole ball drop tool, located below the flow path obstructions with a clear path for a released ball to reach the ball seat to activate the desired tool, serves to facilitate ball/pressure actuation.

FIG. 2 is for purposes of illustration only of a typical use for a ball drop tool 100. Other examples of ball activated tools may use a substantially similar activation mechanism in that the ball is dropped from the ball drop tool 100 and is engaged by a ball seat in the one or more ball activated tools.

FIG. 3 is a diagram showing an example system 300 for controlling the activation of a downhole tool with a ball drop tool, according to various aspects of the present disclosure. The downhole ball dropping system 300 includes a subterranean borehole 304 in which a drill string 190 is located. The drill string 190 may comprise jointed sections of drill pipe 306 suspended from a drilling platform 312 secured at a wellhead. The BHA 351 at a bottom end of the drill string 190 includes a drill bit 316 to penetrate earth formations and, for purposes of this example, includes one or more ball activated tools 318 positioned uphole of the drill bit 316. In only one example, the ball activated tool 318 may be an underreamer 244, as illustrated in FIG. 2, to widen the borehole 304 by operation of selectively deployable cutting elements. The drill string 190 may include one or more additional downhole tools instead of or in addition to the illustrated ball activated tool 318. For example, the ball activated tool 318 may include flow bypass tools, coring tools during cementing operations, liner hanger tools, and/or fracturing operations.

The BHA 351 may further include other components such as a rotary steerable system, and/or measurement while drilling (MWD)/logging while drilling (LWD) tools. For example, a measurement and control assembly 320 may be included in the BHA 351 that includes measurement instruments to measure borehole and/or drilling parameters.

The ball drop tool 100 is coupled to the drill string 190 in a downhole position that is uphole from the one or more ball activated tools 318 to be activated by balls dropped from the ball drop tool 100. The tool control circuitry 195 (see FIG. 1) of the tool 100 may be coupled (e.g., via a hard-wired electrical connection, wirelessly, or via any type of telemetry) to the MWD BHA 351 so that the MWD BHA 351 can transmit a command to the tool 100 to drop a ball based on a downlink command from the surface or just from the measurement and control assembly 320.

A downhole receiver 336 may be used to receive downlink commands from the surface of a geological formation. The downhole receiver 336 may be separately within the drill string as shown or as part of one of the downhole tools (e.g., ball drop tool 100, measurement and control assembly 320).

Drilling fluid (e.g. drilling "mud," or other fluids that may be in the well), is circulated from a drilling fluid reservoir, for example a storage pit, at the earth's surface (and coupled to the wellhead) by a pump system 332 that forces the drilling fluid down a drilling bore 328, provided by a hollow interior of the drill string 190, so that the drilling fluid exits under relatively high pressure through the drill bit 316. After exiting from the drill string 190, the drilling fluid moves back upwards along the borehole 304, occupying a borehole annulus 334 defined between the drill string 190 and a wall of the borehole 304. Although many other annular spaces may be associated with the system, references to annular pressure, annular clearance, and the like, refer to features of the borehole annulus 334, unless otherwise specified or unless the context clearly indicates otherwise.

System 300 further includes surface control circuitry 340 to send and receive signals to and from downhole equipment (e.g., downhole receiver 336) in the drill string 190. For example, the surface control circuitry 340 may communicate with the downhole measurement and control assembly 320 and/or the tool control circuitry 195 of the ball drop tool 100 through the downhole receiver 336. The surface control circuitry 340 may process data relating to the drilling operations, data from sensors and devices at the surface, data received from downhole, and may control one or more operations of downhole tools and/or surface devices.

Downlink signaling or communicating from the surface to downhole tools may be performed to provide instructions in the form of commands to the drill string tools. For example, in a reaming operation, downlink commands (e.g., ball release commands) may instruct the ball drop tool 100 to release a pre-installed ball for activating or deactivating the one or more ball activated tools 318 positioned downhole from the ball drop tool 100. In an example, the downlink command may be communicated to the downhole receiver 336 that may then communicate the command to the tool control circuitry 195 of the ball drop tool 100. In another example, the downlink command may be communicated directly to the ball drop tool 100 or through the measurement and control assembly 320.

In the example of FIG. 3, the downlink command may instruct one or more of the gate valves 120-122 of the ball drop tool 100 to release one or more balls into the interior passage 170 of the ball drop tool 100. In an embodiment, the gate valves 120-122 may each comprise an electromechanical deployment mechanism such as a solenoid-driven actuator to transition between a retaining position and a releasing position. Electromechanical actuators, such as the solenoid-driven actuator, provide control over a force and a motion profile between the retaining position and the releasing position.

Once the ball is in the interior passage of the ball drop tool 100, the flow of drilling fluid within the central bore 306 will displace the ball downwardly until it lands in a ball seat or a ball seat mandrel in a tool located downhole of the ball drop tool 100, such as the ball activated tool 318. When the ball reaches and engages the ball seat, it operates as an activation ball by allowing the increased pressure in the tool string to activate a mechanism associated with the ball seat, including the reaming operations described above, or any other tool or mechanism that requires an increase in pressure, or a redirection of drilling fluid flow caused by an activation ball engaging a ball seat.

Various methods of downlink signaling may be performed to communicate the downlink command to the downlink receiver 336 and/or the ball drop tool 100. For example, mud pulse telemetry may be used to create a series of momentary pressure changes, or pulses, in the drilling fluid to be detected at the downlink receiver 336. The pulse duration, amplitude, and time between pulses, is detected by the downlink receiver 336 and interpreted as a particular instruction to release a pre-installed ball from the ball drop tool 100. Mud pulse telemetry may include various methods for introducing positive or negative pressure pulses into the drilling fluid. With mud pulse telemetry, the downlink receiver 336 may comprises either a flow meter or a pressure sensor (e.g., a pressure transducer), and a microprocessor, programmed with a telemetry scheme and algorithm for filtering and decoding the pressure pulses received downhole.

In an example, the pressure sensor may be a differential pressure transducer. Substantially any differential transducer may be utilized, however, a differential transducer having a relatively low-pressure range (as compared to the drilling fluid pressure in the interior passage of the ball drop tool 100) tends to advantageously increase a signal amplitude (and therefore the signal to noise ratio). In another example, a differential transducer having a differential pressure range from approximately 0 to 1000 psi may be utilized.

In a different example, the ball drop tool 100 may be used with bi-directional communication, allowing for downlink and uplink signals to be sent at the same time without interference between the two signals. Such interference is avoided by sending downlink and uplink pulses within different frequency bands. For example, the uplink pulses may have a high frequency, while the downlink pulses may have a low frequency, or vice versa.

Although bi-directional communication, including the downlink signaling described herein, is achievable using mud pulse telemetry, other types of telemetry schemes may be used, or a combination of telemetry schemes may be used. For example, assuming downlink signals are generated using mud pulse telemetry, uplink signals may be generated using another type of telemetry, such as electromagnetic telemetry, for example, or vice versa. If the telemetry media is the same for uplink and downlink signaling, then the frequency band of the uplink and downlink signals may be sufficiently different to achieve bi-directional communication. Bi-directional communication may be achieved using any telemetry system with its appropriate uplink receivers and transmitters, for example, pressure transducers for mud pulse telemetry. Bi-directional communication provides the advantage of continuous communication between the surface and downhole tools. In some cases, the downlink may include signals communicated from the surface (or from a lower location in the tool string) through wired pipe.

Figure 4:
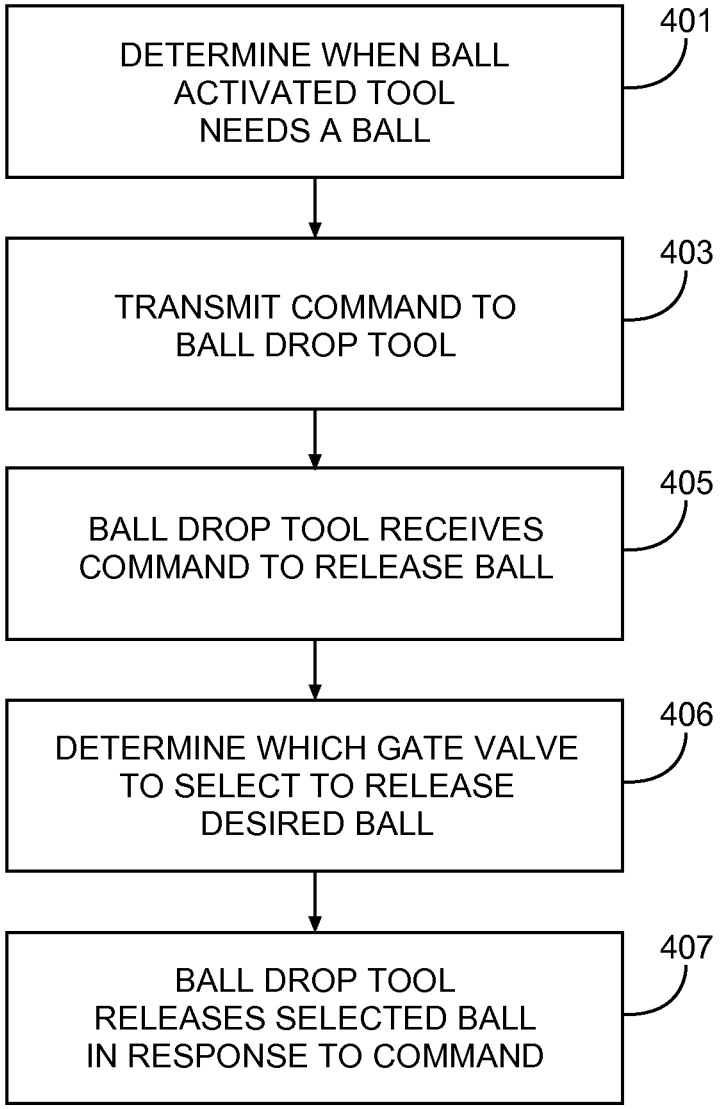
FIG. 4 is a flowchart showing an example method for operation of a ball drop tool.

FIG. 4 is a flowchart showing an example method for operation of a ball drop tool. In block 401, it is determined, during a drilling operation, when a ball activated tool is to receive a ball to activate a mechanism. In block 403, a command is transmitted to the ball drop tool. As described previously, the command may come from the surface control circuitry 340 and/or from the downhole MWD BHA 351. In block 405, the ball drop tool receives the command to release one or more balls. The command may include not only the command to release the ball but a size and/or type of ball (e.g., spherical, semi-ellipsoid, dart, plug) desired for the particular operation. The command may be received by the tool control circuitry 195 for determination of which gate valve circuitry 150-152 to communicate with in order to release the desired ball. In block 406, the tool control circuitry 195 determines which gate valve circuitry 150-152 and, thus, which gate valve to select in order to release the desired size or type of ball, as indicated by the received command. The tool control circuitry 195 may determine which gate valve to select by accessing data stored in memory indicating which type or size of ball is stored in each respective blade. In block 407, the selected gate valve circuitry 150-152 of the ball drop tool is activated to releases the selected ball into the interior passage of the tool in response to the command. As previously indicated, the ball may be selected based on size and/or type, as indicated by the received command.

Figure 5:
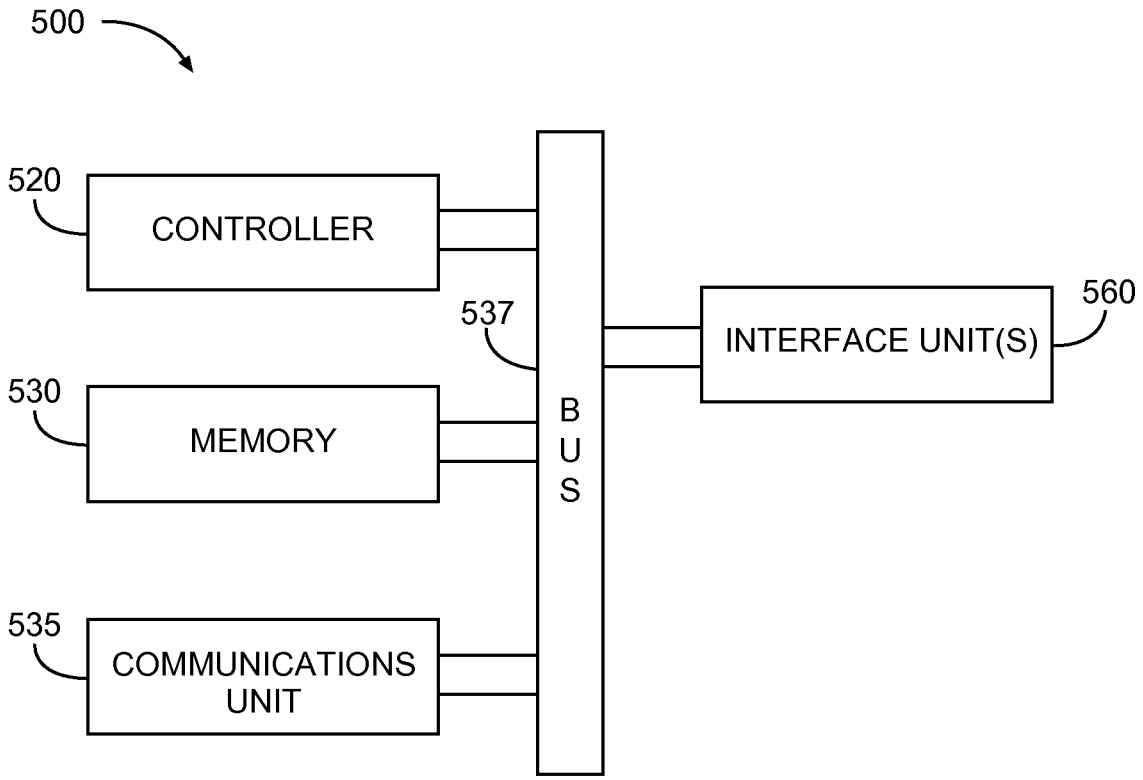
FIG. 5 is a block diagram of an example system operable to execute the methods herein, according to aspects of the present disclosure.

FIG. 5 is a block diagram of an example control system operable to execute the methods herein, according to aspects of the present disclosure. The control system 500 may include circuitry (e.g., a controller, workstation, control logic) 520, a memory 530, a communications unit 535, and an interface unit 560 coupled together over a bus 537. For example, the control system 500 may be implemented as the surface control circuitry, the downhole receiver 336, the tool control circuitry 195, and/or the gate valve circuitry 150-152. The circuitry 520 of the control system 500 may be realized as a processor or a group of processors that may operate independently depending on an assigned function.

The memory 530 may include volatile and/or non-volatile memory. For example, the memory may include read only memory (ROM), random access memory (RAM) (e.g., SRAM, DRAM), flash, optical drives, and/or magnetic disk storage (e.g., hard drives).

The communications unit 535 may include downhole communications for appropriately located sensors in a wellbore. Such downhole communications can include a telemetry system. The communications unit 535 may use combinations of wired communication technologies and wireless technologies at frequencies that do not interfere with ongoing measurements.

The bus 537 may provide electrical conductivity among the components of the system 500. The bus 537 may include an address bus, a data bus, and a control bus, each independently configured or in an integrated format. The bus 537 may be realized using a number of different communication mediums that allows for the distribution of components of the system 500. The bus 537 can include a network. Use of the bus 537 can be regulated by the circuitry 520.

The interface units 560 may take the form of monitors, key boards, touchscreen displays, or sensors for MWD/LWD operations. Many embodiments may thus be realized, and the elements of several will now be listed in detail.

Example 1 is an apparatus comprising: a drilling stabilizer housing, having an interior passage, to be coupled to a drill string; a stabilizing blade on an external surface of the housing, the stabilizing blade comprising a hollow compartment to hold at least one ball selectively releasable from the hollow compartment; a gate valve that couples the hollow compartment of the stabilizing blade to the interior passage of the drilling stabilizer and that is operable to control release of the at least one ball; and gate valve circuitry, coupled to the gate valve, for controlling operation of the gate valve.

In Example 2, the subject matter of Example 1 can optionally include wherein the stabilizing blade is one of a plurality of stabilizing blades on the external surface of the housing.

In Example 3, the subject matter of Examples 1-2 can optionally include wherein the gate valve is one of a plurality of gate valves, each gate valve coupling a respective hollow compartment of the respective stabilizing blade to the interior passage.

In Example 4, the subject matter of Examples 1-3 can optionally include wherein the gate valve circuitry is one of a plurality of gate valve circuitries, each gate valve circuitry coupled to a respective gate valve.

In Example 5, the subject matter of Examples 1-4 can optionally include wherein the plurality of stabilizing blades each holds a different size ball.

In Example 6, the subject matter of Examples 1-5 can optionally include wherein the plurality of stabilizing blades each holds a different type of ball selected from the group consisting of a spherical ball, a semi-ellipsoid ball, a dart, and a plug.

In Example 7, the subject matter of Examples 1-6 can optionally include wherein each of the plurality of gate valves is selectively activated.

In Example 8, the subject matter of Examples 1-7 can optionally include wherein each of the plurality of gate valves is selectively activated by its respective gate valve circuitry, the respective gate valve circuitry being part of a plurality of gate valve circuitries.

In Example 9, the subject matter of Examples 1-8 can optionally include tool control circuitry coupled to the plurality of gate valve circuitries, the tool control circuitry to determine which gate valve circuitry to activate.

In Example 10, the subject matter of Examples 1-9 can optionally include wherein the tool control circuitry comprises memory to store a size and/or type of ball located in each stabilizing blade.

In Example 11, the subject matter of Examples 1-10 can optionally include wherein the tool control circuitry is to receive commands to select one of the respective gate valves in response to the received commands.

Example 12 is a method comprising: receiving a command comprising a size or a type of selected ball to release from one of a plurality of hollow compartments of a ball drop tool coupled to a downhole drill string, each hollow compartment coupled to a gate valve; determining which gate valve to select in response to the received command; and activating the selected gate valve to release the selected ball from the ball drop tool through the selected gate valve.

In Example 13, the subject matter of Example 12 can optionally include wherein receiving the command comprises receiving a downlink signal through mud pulse telemetry.

In Example 14, the subject matter of Examples 12-13 can optionally include wherein receiving the downlink signal comprises receiving the downlink signal using telemetry from surface control circuitry.

In Example 15, the subject matter of Examples 12-14 can optionally include wherein receiving the command comprises receiving the command from a bottom hole assembly (BHA).

In Example 16, the subject matter of Examples 12-15 can optionally include: engaging a ball seat in a ball activated tool with the ball; and activating a mechanism of the ball activated tool.

In Example 17, the subject matter of Examples 12-16 can optionally include positioning the ball drop tool downhole from a surface of a geological formation and uphole from the ball activated tool.

In Example 18, the subject matter of Examples 12-17 can optionally include wherein activating the selected gate valve to release the selected ball from the ball drop tool through the selected gate valve comprises releasing one of a plurality of types of ball from the ball drop tool selected from the group consisting of a spherical ball, a semi-ellipsoid ball, a dart, and a plug.

Example 19 is a downhole ball dropping system, the system comprising: a drill string comprising a ball activated tool; and a drilling stabilizer coupled within the drill string downhole from a surface of a geological formation and uphole from the ball activated tool, wherein the drilling stabilizer comprises: a plurality of blades on an external surface of a housing, the plurality of blades each having a hollow compartment to retain a different respective size or type of ball as compared to the other hollow compartments; and a gate valve coupled to an output of a respective hollow compartment of each blade of the plurality of blades, the gate valve configured to be actuated in response to a signal from a downlink receiver to release a selected size or type of ball from its respective hollow compartment.

In Example 20, the subject matter of Example 19 can optionally include tool control circuitry in the drilling stabilizer and comprising memory to store a type or size of ball retained in each respective hollow compartment.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be used and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. An apparatus comprising:

a drilling stabilizer housing, having an interior passage, to be coupled to a drill string;

a stabilizing blade on an external surface of the housing, the stabilizing blade comprising a hollow compartment to hold at least one ball selectively releasable from the hollow compartment;

a gate valve that couples the hollow compartment of the stabilizing blade to the interior passage of the drilling stabilizer and that is operable to control release of the at least one ball; and gate valve circuitry, coupled to the gate valve, for controlling operation of the gate valve.

2. The apparatus of claim 1, wherein the stabilizing blade is one of a plurality of stabilizing blades on the external surface of the housing.

3. The apparatus of claim 2, wherein the gate valve is one of a plurality of gate valves, each gate valve coupling a respective hollow compartment of the respective stabilizing blade to the interior passage.

4. The apparatus of claim 3, wherein the gate valve circuitry is one of a plurality of gate valve circuitries, each gate valve circuitry coupled to a respective gate valve.

5. The apparatus of claim 4, wherein each of the plurality of gate valves is selectively activated.

6. The apparatus of claim 5, wherein each of the plurality of gate valves is selectively activated by its respective gate valve circuitry, the respective gate valve circuitry being part of a plurality of gate valve circuitries.

7. The apparatus of claim 6, further comprising tool control circuitry coupled to the plurality of gate valve circuitries, the tool control circuitry to determine which gate valve circuitry to activate.

8. The apparatus of claim 7, wherein the tool control circuitry comprises memory to store a size and/or type of ball located in each stabilizing blade.

9. The apparatus of claim 7, wherein the tool control circuitry is to receive commands to select one of the respective gate valves in response to the received commands.

10. The apparatus of claim 2, wherein the plurality of stabilizing blades each holds a different size ball.

11. The apparatus of claim 2, wherein the plurality of stabilizing blades each holds a different type of ball selected from the group consisting of a spherical ball, a semi-ellipsoid ball, a dart, and a plug.

12. A method comprising:

receiving a command comprising a size or a type of selected ball to release from one of a plurality of hollow compartments, each hollow compartment formed in one of a plurality of blades on an external surface of a housing of a drilling stabilizer coupled to a downhole drill string, and each hollow compartment coupled to a gate valve;

determining which gate valve to select in response to the received command; and activating the selected gate valve to release the selected ball from the ball drop tool through the selected gate valve.

13. The method of claim 12, wherein receiving the command comprises receiving a downlink signal through mud pulse telemetry.

14. The method of claim 13, wherein receiving the downlink signal comprises receiving the downlink signal using telemetry from surface control circuitry.

15. The method of claim 12, wherein receiving the command comprises receiving the command from a bottom hole assembly (BHA).

16. The method of claim 12, further comprising:

engaging a ball seat in a ball activated tool with the ball; and activating a mechanism of the ball activated tool.

17. The method of claim 12, further comprising positioning the drilling stabilizer downhole from a surface of a geological formation and uphole from the ball activated tool.

18. The method of claim 12, wherein activating the selected gate valve to release the selected ball from the ball drop tool through the selected gate valve comprises releasing one of a plurality of types of ball from the ball drop tool selected from the group consisting of a spherical ball, a semi-ellipsoid ball, a dart, and a plug.

19. A downhole ball dropping system, the system comprising:

a drill string comprising a ball activated tool; and a drilling stabilizer coupled within the drill string downhole from a surface of a geological formation and uphole from the ball activated tool, wherein the drilling stabilizer comprises:

a plurality of blades on an external surface of a housing, the plurality of blades each having a hollow compartment to retain a different respective size or type of ball as compared to the other hollow compartments; and a gate valve coupled to an output of a respective hollow compartment of each blade of the plurality of blades, the gate valve configured to be actuated in response to a signal from a downlink receiver to release a selected size or type of ball from its respective hollow compartment.

20. The downhole ball dropping system of claim 19, further comprising tool control circuitry in the drilling stabilizer and comprising memory to store a type or size of ball retained in each respective hollow compartment.

* * * * *